US012291856B2

(12) United States Patent
Levi

(10) Patent No.: US 12,291,856 B2
(45) Date of Patent: May 6, 2025

(54) ACCESSIBLE SUBFLOOR BATH

(71) Applicant: Jonathan Levi, Boston, MA (US)

(72) Inventor: Jonathan Levi, Boston, MA (US)

( * ) Notice: Subject to any disclaimer, the term of this patent is extended or adjusted under 35 U.S.C. 154(b) by 0 days.

(21) Appl. No.: 18/921,563

(22) Filed: Oct. 21, 2024

(65) Prior Publication Data

US 2025/0043555 A1 Feb. 6, 2025

Related U.S. Application Data

(63) Continuation of application No. 18/390,611, filed on Dec. 20, 2023, now Pat. No. 12,129,635.

(60) Provisional application No. 63/433,858, filed on Dec. 20, 2022.

(51) Int. Cl.
*E03C 1/23* (2006.01)
*E03C 1/232* (2006.01)

(52) U.S. Cl.
CPC ..... *E03C 1/2306* (2013.01); *E03C 1/232* (2013.01)

(58) Field of Classification Search
CPC ..... E03C 1/2306; E03C 1/232; E04H 4/065
USPC ... 4/495, 560.1, 564.1, 656.1, 651, 653, 680
See application file for complete search history.

(56) References Cited

U.S. PATENT DOCUMENTS

| | | | | |
|---|---|---|---|---|
| 2,889,559 A * | 6/1959 | Lyon, Jr. | E03C 1/266 | 4/642 |
| 3,553,743 A * | 1/1971 | Lodige | E04H 4/065 | 4/495 |
| 3,935,600 A * | 2/1976 | Scribner | E04H 4/065 | 4/495 |
| 4,106,134 A * | 8/1978 | Schiron | E04H 4/065 | 4/495 |
| 2014/0237713 A1* | 8/2014 | Kanetis | E04H 4/065 | 4/495 |

FOREIGN PATENT DOCUMENTS

| | | | |
|---|---|---|---|
| GB | 2438224 A * | 11/2007 | E03C 1/232 |
| GB | 2537174 A * | 10/2016 | E04H 4/065 |

* cited by examiner

*Primary Examiner* — Tuan N Nguyen
(74) *Attorney, Agent, or Firm* — Nutter McClennen & Fish LLP

(57) ABSTRACT

A system is provided. The system may include one or more of a tub, a platform, and a lift, coupled to a bottom surface of the platform. The tub includes a top surface, a bottom surface, and a concave well between the top and bottom surfaces. The platform includes water openings extending through a thickness of the platform. The lift is disposed within the tub and is configured to raise and lower the platform within the well.

20 Claims, 11 Drawing Sheets

ACCESSIBLE SUBFLOOR BATH

PRIORITY

This patent application is a continuation application of U.S. patent application Ser. No. 18/390,611, filed Dec. 20, 2023, entitled, ACCESSIBLE SUBFLOOR BATH and naming Jonathan Levi as the inventor, which claims priority from provisional U.S. patent application No. 63/433,858, filed Dec. 20, 2022, entitled, SUBFLOOR ACCESSIBLE BATH and naming Jonathan Levi as the inventor, the disclosures of which are incorporated herein, in their entireties, by reference.

FIELD

Illustrative embodiments of the invention generally relate to building architecture and, more particularly, various embodiments of the invention relate to bathing facility construction.

BACKGROUND

Typical bath systems that are configured to be accessible to mobility-impaired people include walk-in tubs and open shower stalls. Many conventional walk-in tubs may restrict access from people that rely on a wheelchair to move about. Additionally, many walk-in showers do not allow for a bathtub to be fitted in the same footprint, which would save space while allowing one to have both a shower and a bath in one room. Open shower stalls often do not allow for a bath.

SUMMARY OF VARIOUS EMBODIMENTS

In accordance with one embodiment of the invention, an accessible bath has a tub with a top surface, a bottom surface, and a concave well between the top and bottom surfaces. The platform may include water openings extending through the platform. A lift within the tub is configured to raise and lower the platform within the well.

In accordance with other embodiments, the top surface of the tub may be configured to be substantially coplanar with a floor of a building when installed.

In accordance with other embodiments, the platform may be configured to support a seated user on the platform.

In accordance with other embodiments, the accessible bath may include a filler in one or more sides of the well, configured to add water at a predetermined temperature and volume to the tub.

In accordance with other embodiments, the accessible bath may include a drain, proximate to the bottom surface of the tub, configured to retain water within the well when closed and allow water to drain from the well when opened. The accessible bath may also include a macerator, coupled to the drain, configured to break up debris from the tub when water is drained and provide the water and broken up debris to a water outlet.

In accordance with other embodiments, the accessible bath may include a door, within and coplanar with the platform, configured to provide access to the well and the lift when opened.

In accordance with other embodiments, the accessible bath may include a plurality of vertical rollers, coupled to upper portions of the lift, configured to maintain a consistent distance between the lift and the well.

In accordance with other embodiments, the accessible bath may include a plurality of springs, coupled to the plurality of rollers, to provide outward horizontal force to the plurality of rollers to maintain contact with side surfaces of the well.

In accordance with another embodiment of the invention, an accessible bath includes a tub, configured to hold water, a platform, a lift, and an actuator. The tub also has top and bottom surfaces and a concave well, affixed to and conforming to an opening at the top surface of the tub. The tub may include a drain, disposed in proximity to the bottom surface, configured to retain water within the well when closed and allow water to drain from the well when opened. The platform may be configured to fit within the opening when in a raised position. The lift may be affixed to an underside of the platform and may be configured to raise the platform to the raised position and lower the platform within the well. The actuator may be coupled to the lift and may be configured to cause the lift to raise or lower the platform.

In accordance with another embodiment of the invention, a method is provided. The method may include closing a drain within a well of a tub to prevent water flow from the tub, initiating a water flow at a desired temperature and volume into the tub, controlling, by a lift coupled within the tub, a platform configured to allow water flow through the platform; and lowering, by the lift, the platform to a depth within the well. The lift may be configured to raise or lower the platform within the well.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a subfloor accessible bath (also referred to herein as the "accessible bath") safely provides tub access to a seated user. The user may be seated on a seat, platform, or wheelchair on a platform, and the user or another individual may initiate lowering the platform within a well of the tub. The platform allows water to pass through it into the tub and may be lowered to a given depth within the tub. When use of the tub is concluded, the user or other individual may initiate raising the platform until the platform is flush or nearly flush with a floor level. The user may safely step off the platform or move a wheelchair off the platform.

Certain conventional art accessible baths known to the inventor include walk-in bathtubs (e.g., having a sealable door or stairs into the basin) and/or open-concept showers (e.g., shower stalls without doors or rims). However, these types of baths occupy significant floor space or may not be suitable for mobility-impaired users. Illustrative embodiments of the present invention solve this problem. Specifically, in illustrative embodiments, an accessible bath is provided for people having various levels of mobility. Accordingly, while typically only mobile or semi-mobile people can access a walk-in bathtub, the accessible bath is accessible to people lacking the ability to walk as well as people able to walk. The accessible bath includes a lift positioned within a tub such that the bather can be safely lowered into the tub. Additionally, the rim of the tub preferably rests level with the surrounding floor providing access to users of many levels of mobility. Details of various embodiments are discussed below.

Figure 1A:
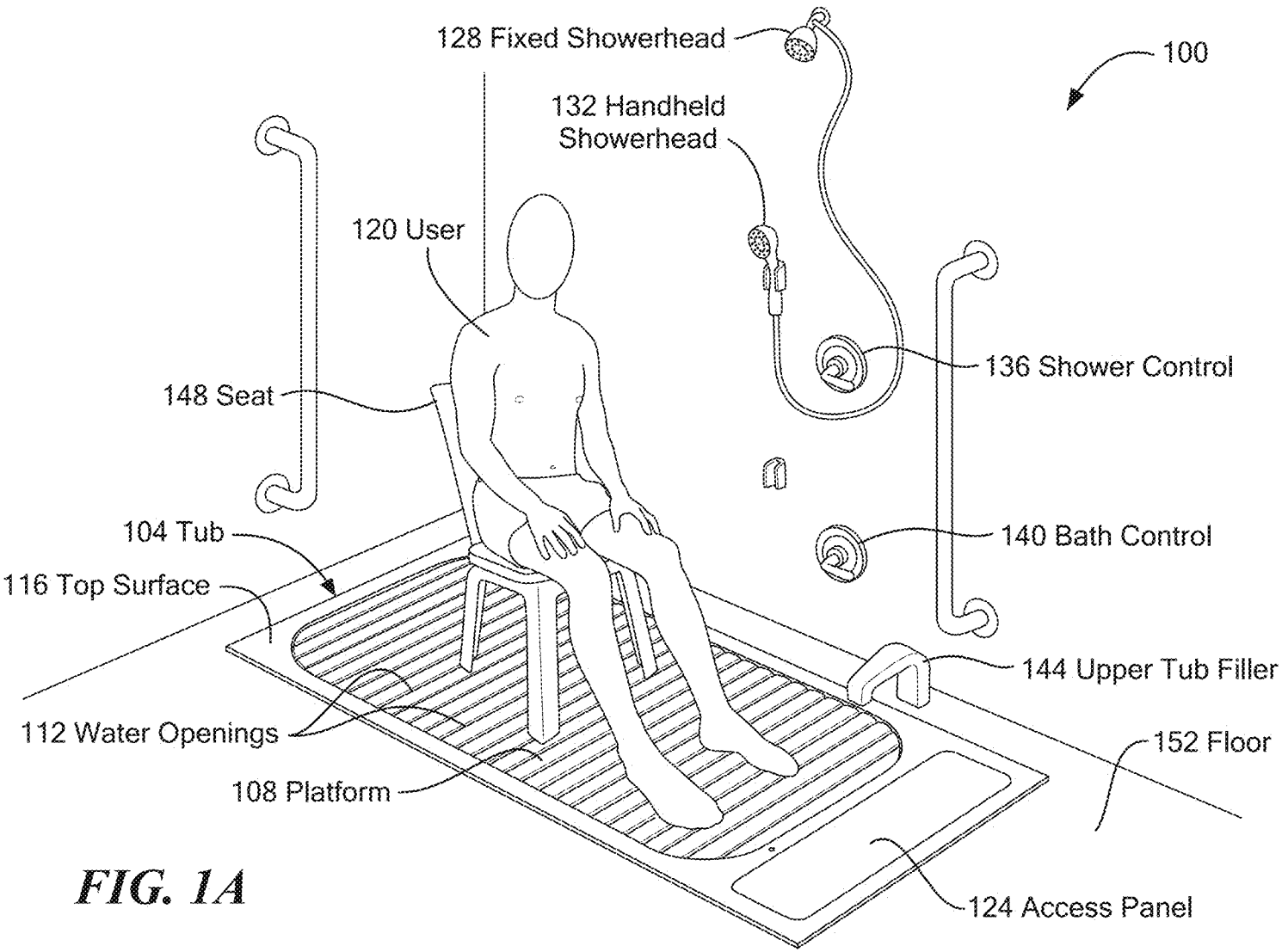
FIG. 1A schematically shows a perspective view of an accessible bath in a raised position with a seated user in accordance with illustrative embodiments of the invention.

FIG. 1A schematically shows a perspective view of an accessible bath in a raised position with a seated user 100 in accordance with illustrative embodiments of the invention. As shown in FIG. 1A, the accessible bath 100 may include a tub 104 with a tub top surface 116, a platform 108 with water openings 112 therethrough for moving up and down within the tub 104, and an access panel 124 to provide access to internal system components. As shown, a user 120 may be seated on a seat or chair 148 atop the platform 108. The seat or chair 148 may be affixed to a top surface of the platform 108 or placed on the platform 108. The top surface 116 of the tub 104 may be approximately level with the floor 152 of the bath area.

FIG. 1A illustrates the platform 108 in a raised position, where the accessible bath may be used to shower the user 120 in either a seated or a standing position. Water from the fixed showerhead(s) 128 or handheld showerhead(s) 132 may drain through the water openings 112 to one or more drains within the tub 104 (shown in FIG. 3). The platform 108 in this embodiments is generally planar and remains in a generally parallel orientation to the floor 152 at all times. This may be required for user 120 safety. FIG. 1A also illustrates the accessible bath in the raised position with the user 120 safely seated and prior to the platform 108 being lowered within the tub 104.

The area around the accessible bath 100 may include various fixtures to provide water to the user 120 and control the accessible bath 100, including any number of fixed showerheads 128, any number of handheld showerheads 132, any number of shower controls 136, any number of bath controls 140, and any number of upper tub fillers 144. The fixed showerheads 128, handheld showerheads 132, shower controls 136, and bath controls 140 may be on any mounting surface(s) of the accessible bath 100, including a vertical surface in front of, behind, or to the side or angled with respect to the user 120. The floor 152 may include any number of drains in addition to drains specifically discussed herein. Walls adjacent to the accessible bath 100 may include one or more grab bars or supports to facilitate the user 120 resting on the seat 148 or standing. The access panel 124 may allow access to various electrical, plumbing, and control devices associated with the accessible bath 100 for maintenance, cleaning, and replacement purposes.

As noted above, the platform 108 is preferably flat and coplanar with the floor 152 when in the raised position. In illustrative embodiments, the platform 108 includes a series of evenly spaced slats or boards with water openings 112 between adjacent slats. In another embodiment, the platform 108 may be a flat surface and the water openings 112 may be holes of any particular shape, pattern, or regularity. For safety reasons, the water openings 112 may be small enough to keep fingers or toes from becoming lodged or stuck in the openings 112. The water openings 112 may also be sufficiently small such that wheelchair wheels can traverse the water openings 112 without becoming stuck or inhibiting wheelchair movement. In one embodiment, the floor 152 may be sloped (e.g., at a slight non-zero angle relative to the floor) to cause water flow to and through the platform 108. In one embodiment, the accessible bath 100 may include one or more upper tub fillers 144 that provide water directly to the tub 104 rather than through showerheads 128, 132. This may beneficially keep water within the tub 104 and facilitate cleaning for the accessible bath 100.

The platform 108 may be constructed from flat and rigid materials that do not absorb water, such as polymer or treated wood slats. For example, the slats may be teak, white oak, maple, cedar, or any water-resistant wood. In other examples, the slats may be constructed from crosslinked vinyl, crosslinked polystyrene, polycarbonate, acrylonitrile butadiene styrene (ABS), or any supportive polymer or copolymer. In other examples, the slats may be metal, glass, ceramic, stone, any suitable slat material, or any combination thereof.

Figure 1B:
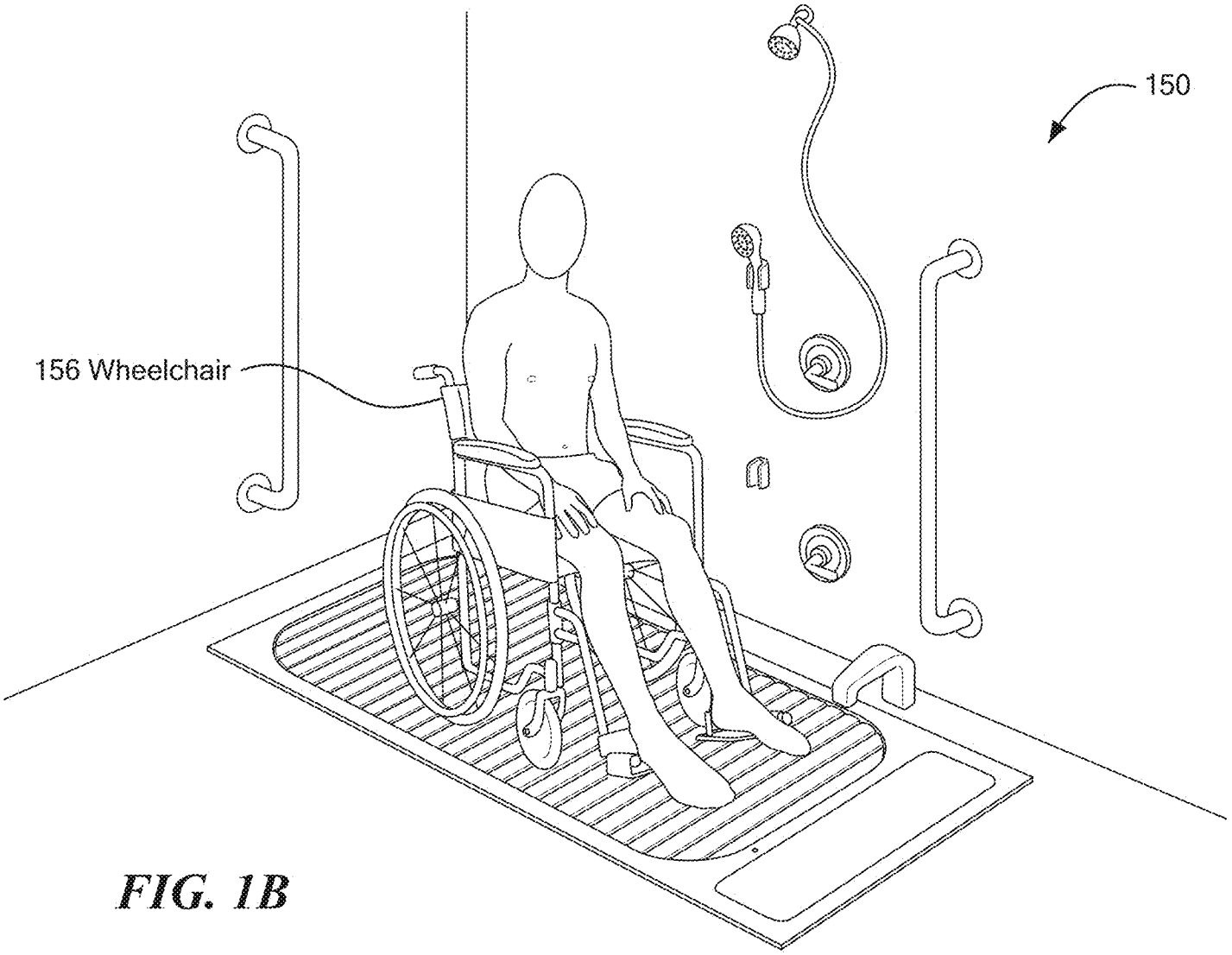
FIG. 1B schematically shows a perspective view of an accessible bath in a raised position with a user seated in a wheelchair in accordance with illustrative embodiments of the invention.

FIG. 1B schematically shows a perspective view of an accessible bath in a raised position with a user seated in a wheelchair 150 in accordance with illustrative embodiments of the invention. As shown in FIG. 1B, a user 120 in a wheelchair 156 may be able to safely use the accessible bath 150, both for conventional showering as previously described or bathing within the tub 104. Because of the general coplanarity of the platform 108 in a raised position with the floor 152, the user 120 in a wheelchair 156 may easily move the wheelchair 156 onto a center portion of the platform 108 before lowering the platform 108. In one embodiment, the platform 108 may have a width to accommodate common wheelchairs 156.

Figure 2:
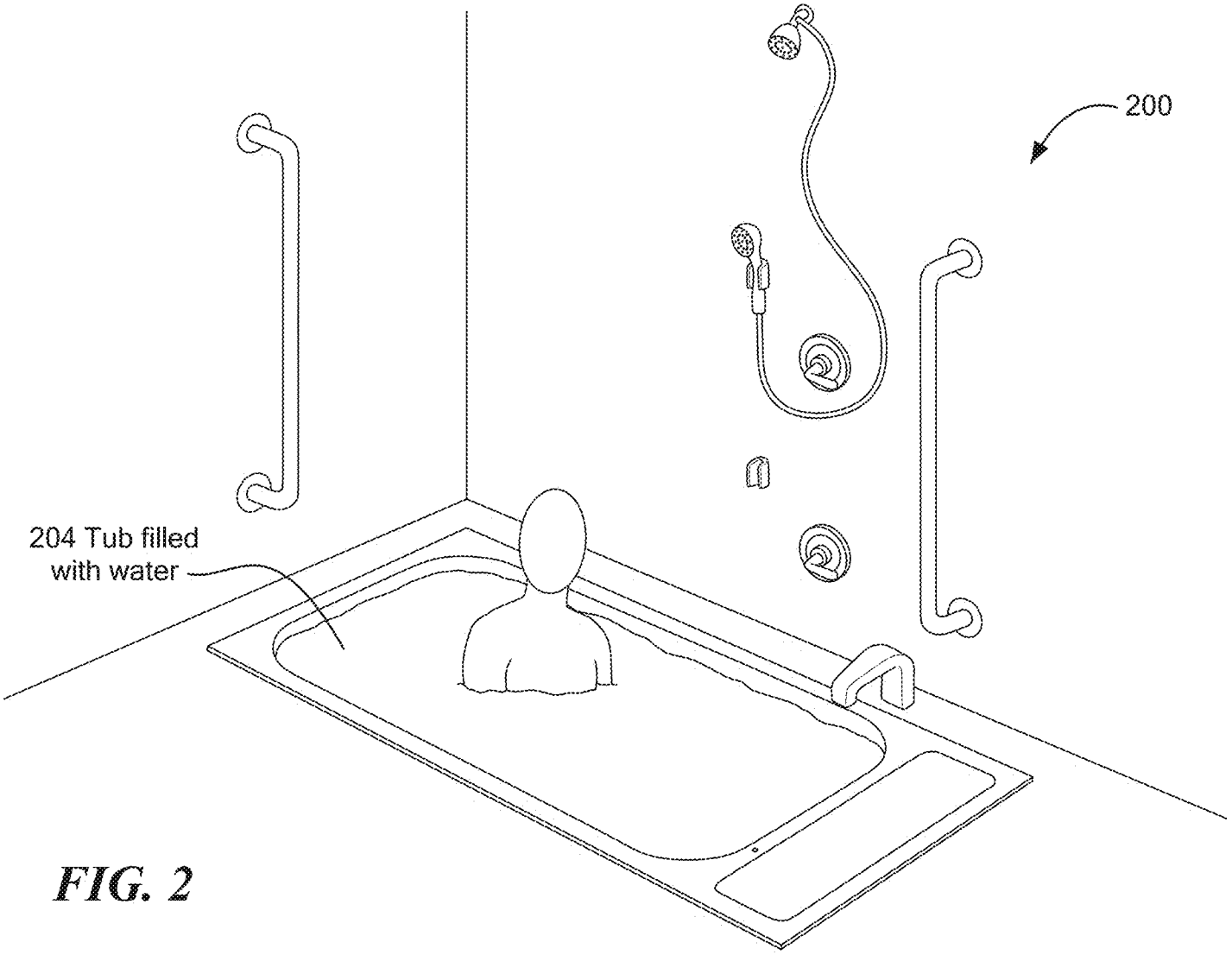
FIG. 2 schematically shows a perspective view of an accessible bath in a lowered position with water in the tub in accordance with illustrative embodiments of the invention.

FIG. 2 schematically shows a perspective view of an accessible bath in a lowered position with water in the tub in accordance with illustrative embodiments of the invention. As shown in FIG. 2, a user 120 may be immersed in the tub filled with water 204, including up to a chest or shoulder level as shown. In one embodiment, the platform 108 may be in a lowered position. In another embodiment, the platform 108 may be moved to a number of predetermined depths between the maximum lowered position and the raised position (e.g., 25% lower, 50% lower, 75% lower, or 100% lower). In another embodiment, the platform 108 may be lowered to any depth selected by the user 120 or other individual between the raised position and a 100% lowered position. This may beneficially provide great flexibility to accommodate different users 120 with different heights or to customize the water depth for specific therapeutic uses (e.g., foot or ankle bath).

Figure 3:
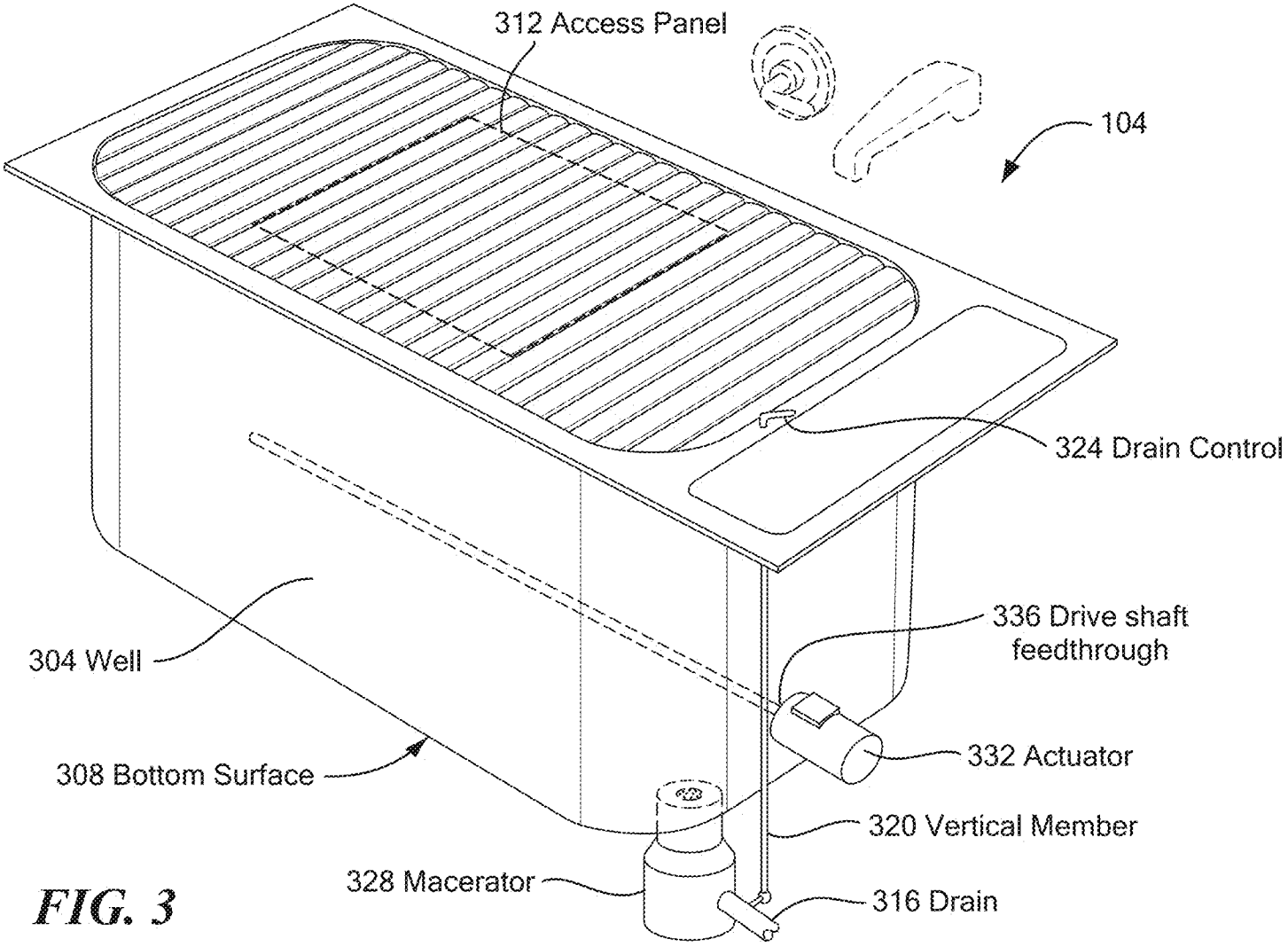
FIG. 3 schematically shows a perspective view of a tub in accordance with illustrative embodiments of the invention.

FIG. 3 schematically shows a perspective view of the tub 104 in accordance with illustrative embodiments of the invention. FIG. 3 illustrates the tub 104 with the platform 108 in the raised position and with various additional features shown and reflect the tub 104 just prior to installation within a shower area of a building.

The tub 104 may include a well 304 with upwardly extending sides (e.g., generally vertical or at some angle to the vertical) and a bottom surface 308. The length and width may be of many different dimensions, although a length under 6 feet, a width under 3.5 feet, and a depth below 4 feet may be common. As with any tub, the illustrative tub 104 is configured to hold water for a bath. The tub 104 may be made from a molded polymer, an extruded polymer, an extruded metal, a stamped metal, glass, concrete, frame and tile, frame and liner, any basin construct, or any combination thereof. In certain embodiments, the tub 104 may have a volume (i.e., the well volume), an opening at its top, and vertical dimension (e.g., depth) sufficient to immerse a person in a wheelchair 156 up to the user's 120 shoulders and/or neck, assuming the user 120 is of a certain height and weight. For example, the tub 104 may be produced having opening dimensions equivalent or comparable to a standard in-home bathtub.

The tub 104 has a drain 316 proximate the bottom surface 308 to allow water to drain from the well 304. The drain 316 may have a vertical member 320 coupled to a drain control 324. The drain control 324 allows the user 120 or other individual to close the drain 316 when filling the tub 104 or open the drain 316 to allow water to leave the tub 104.

In further embodiments, the tub 104 may be a jetted tub. A jetted tub may provide certain therapeutic or medical benefits to certain users of the accessible bath. Jet quantity and position may be determined on an as-needed or as-desired basis. Jet direction and water flow may be user adjustable. In further embodiments, the tub 104 may have one or more lights in the top surface 116, the well 304, and/or the bottom surface 308. In some embodiment, the lights may of fixed, selectable, or changing colors or brightness.

In some embodiments, the tub 104 is configured to provide a seamless transition from the floor 152 of the building having the accessible bath installed, and the tub top surface 116. For example, the tub 104 may be positioned on a subfloor cut-out configured to support the accessible bath with installed flooring material butting against the top surface 116. In certain embodiments, a wedge or small ramp can be deployed about the tub 104 to provide a smooth transition from the surrounding floor 152 to the tub 104. As used herein, a smooth transition may be a transition from the floor 152 surrounding the tub 104 onto the top surface 116 that does not impede access from a mobility-impaired person, a wheelchair, or any person using the accessible bath.

In some embodiments, the accessible bath may include a macerator 328 coupled to the drain 316. The macerator 328 reduces the size of solids to smaller pieces to prevent water outlets and wastewater pipes from becoming clogged. In one embodiment, the macerator 328 may include a motor that drives teeth or other mechanical cutters that reduces solids. The macerator 328 may be controlled by various means, as described herein. In one embodiment, the macerator 328 operates whenever the drain 316 is open and water flows through the drain 316 and may be inhibited from running if either the drain 316 is closed or there is no water flowing through the drain 316.

In some embodiments, the accessible bath may include an actuator or lift actuator 332 that controls raising and lowering the platform 108, as described herein. In illustrative embodiments, the actuator 332 may be outside the well 304 and accesses a lift through a drive shaft feedthrough 336 that provides a water-tight seal about a drive mechanism configured to operate the lift. For example, the feedthrough 336 may include a magnetic feedthrough, an o-ring sealed feedthrough, an oil-sealed feedthrough, a cutlass-type waterproof bearing, or any combination thereof. The actuator 332 may be implemented with a motor. Among other things, the motor may be any one of a direct drive motor, an indirect drive motor, an AC electric motor, a DC electric motor, a stepper motor, a servo motor, a hydraulic motor, a compressed air motor, a capacitor-start natural gas and/or propane motor, or any suitable motor. In a preferred embodiment, the motor is a low voltage direct drive motor.

Figure 4:
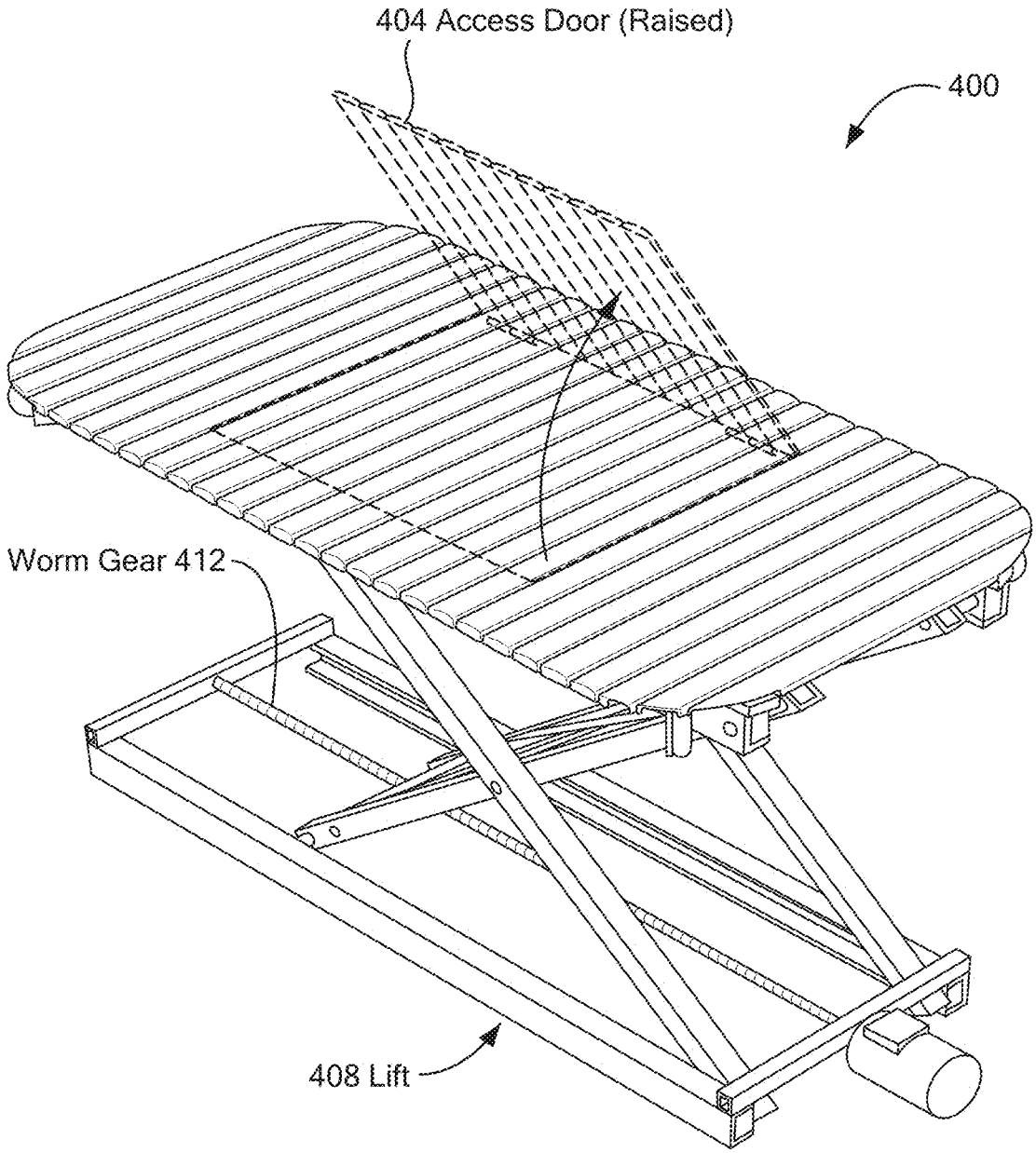
FIG. 4 schematically shows a perspective view of a lift in accordance with illustrative embodiments of the invention.

FIG. 4 schematically shows a perspective view of a lift and platform 400 in accordance with illustrative embodiments of the invention. FIG. 4 leaves out the tub 104 to illustrate exemplary elements of the lift 408 more clearly. The lift and platform 400 may include the platform 108 coupled to top surfaces of a lift 408. In illustrative embodiments, the lift 408 may be implemented as a scissors lift that keeps the platform 108 level as the platform 108 is raised or lowered. In some embodiments, the lift 408 may be removable from the tub 104. The actuator 332 may drive a worm gear 412 through a threaded fitting to cause the platform 108 to raise or lower. Details of the illustrated scissors lift 408 are shown and described in greater detail in FIG. 5.

FIG. 4 also illustrates a hinged access door 404 while the platform 108 is in a raised position. The access door 312 may be movable about its hinge at any of a variety of different positions of the platform 108 within the well 304. In another embodiment, the access door 312 may be removable from the platform 108. The access door 312 allows the user 120 or other individual to clean beneath the platform 108, such as the sides of the well 304 or the bottom surface 308 of the tub 104. The access door 312 may also allow maintenance access to the actuator 332, the lift 408, and/or the drain 316/macerator 328.

Figure 5:
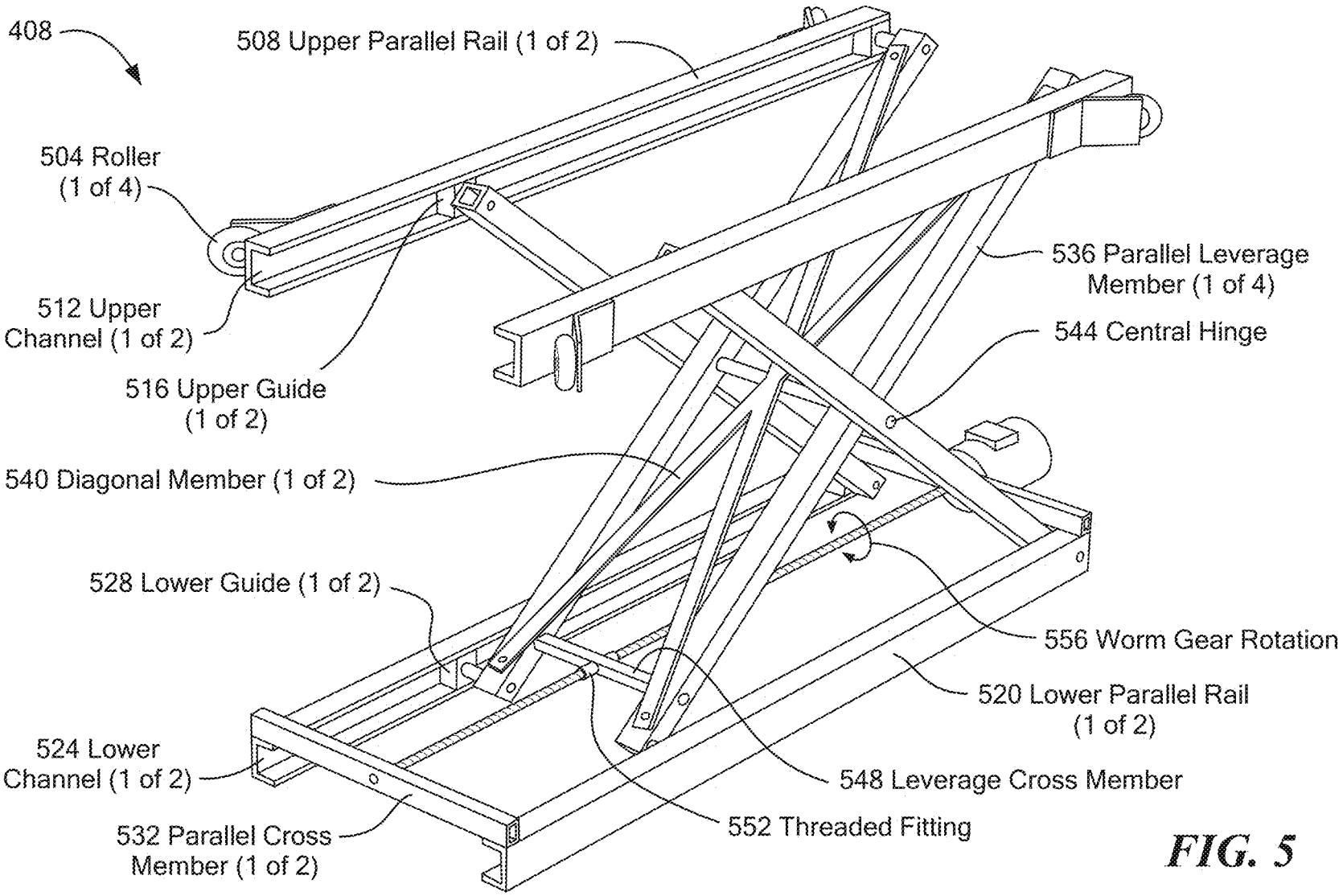
FIG. 5 schematically shows a perspective view of the lift in accordance with illustrative embodiments of the invention.

FIG. 5 schematically shows a perspective view of the lift 408 in accordance with illustrative embodiments of the invention. The lift 408 may be any suitable lift technology, including a scissors lift, a telescoping lift, a hydraulic lift, or a traction lift. FIG. 5 illustrates possible components and features of a scissors lift embodiment. Other embodiments with different features may be realized. The platform 108 has been removed from FIG. 5 to more clearly show principal components and features of the lift 408.

The lift 408 includes a base configured to rest upon the bottom surface 308 of the tub 104. The base may include lower parallel rails 520, which may include slip-resistant feet or pads to prevent slipping on the bottom surface 308. In one embodiment, the lower parallel rails 520 may be rigidly fastened to the bottom surface 308 of the tub 104. In some embodiments, the base may be configured to fit into the well 304 such that there is a minimal gap between the base and the well 304. In one embodiment, the lift 408 may be secured to the tub 104 at the drive shaft feedthrough 336 to the actuator 332. Indeed, the lift 408 may be secured to the tub 104 at any of a number of other locations as well.

The lower parallel rails 520 may include lower channels 524 to allow lower guides 528 to slide lengthwise within. Rigidity of the lower parallel rails 520 may be provided through parallel cross members 532. In illustrative embodiments, one parallel cross member 532 (closest to the actuator 332) may include a hole for the worm gear 412 to pass through. Another parallel cross member 532 (at opposite end of the lower parallel rails 520 from the actuator 332) may include a coupling that retains an end of the worm gear 412 while allowing the worm gear 412 to freely rotate in either direction.

The lift 408 may include upper parallel rails 508 fastened to a bottom surface of the platform 108. The upper parallel rails 508 may include upper channels 512 to allow upper guides 516 to lengthwise slide within. The scissors lift is configured such that the upper guides 516 slide in concert with the lower guides 528.

The upper 516 and lower 528 guides may be made from any suitable material, including polymers, wood, metal, ceramic, stone, or glass. In preferred embodiments, the upper 516 and lower 528 guides are made from a low coefficient of friction material to facilitate travel within the upper channels 512 and the lower channels 524, respectively.

The upper parallel rails 508 may be coupled to the lower parallel rails 520 by a group of parallel leverage members 536. In illustrative embodiments, there are four parallel leverage members 536.

One pair of parallel leverage members 536 may be coupled to an end of the lower parallel rails 520 at the bottom and to the upper guides 516 at the upper end. The coupling at the lower end allows rotation around an axle (e.g., screw or other fastener), but no lengthwise movement relative to the lower parallel rails 520. The coupling to the upper guides 516 at the upper end allows lengthwise movement relative to the upper parallel rails 508.

Another pair of parallel leverage members 536 is coupled to an end of the lower parallel rails 520 at the top and to the lower guides 528 at the bottom end. The coupling at the upper end allows rotation around an axle (e.g., screw or other fastener) but no lengthwise movement relative to the upper parallel rails 508. The coupling to the lower guides 528 at the lower end allows lengthwise movement relative to the lower parallel rails 520. In illustrative embodiments, a pair of diagonal members 540 provide structural integrity between the pair of parallel leverage members 536 that are fastened to the leverage cross member 548. A leverage cross member 548 between the other pair of leverage members 536 is axially coupled to each of the other pair of leverage members 536 by a screw or other type of fastener that allows free rotation in either direction. A threaded fitting 552 may be generally centrally disposed in the leverage cross member 548. The worm gear 412 passes through the threaded fitting and threads of the worm gear 412 engage threads within the threaded fitting 552. The actuator 332 causes worm gear rotation 556 that moves the leverage cross member 548 and threaded fitting 552 relative to the actuator 332.

For example, when the actuator 332 rotates the worm gear 412 in a clockwise direction, the leverage cross member 548 may move away from the actuator 332, causing the upper 516 and lower 528 guides to move toward the distal (relative to the actuator 332) parallel cross member 532 and thereby lower the upper parallel rails 508 (and thereby the platform 108 coupled to the upper parallel rails 508). Correspondingly, when the actuator 332 rotates the worm gear 412 in a counterclockwise direction, the leverage cross member 548 may move toward the actuator 332, causing the upper 516 and lower 528 guides to move away from the distal parallel cross member 532 and thereby raise the upper parallel rails 508 (and thereby the platform 108 coupled to the upper parallel rails 508).

Ends of the upper parallel rails 508 may be coupled to corresponding rollers 504, which are configured to travel vertically along the inside walls of the well 304. The rollers 504 allow for steady and smooth lifting and lowering motion of the platform 108 by reducing or eliminating sideways wobble. The rollers 504 may also keep the platform centered within the opening in the top surface 116 that the platform 108 closely fits within, when in the raised position.

Figure 6:
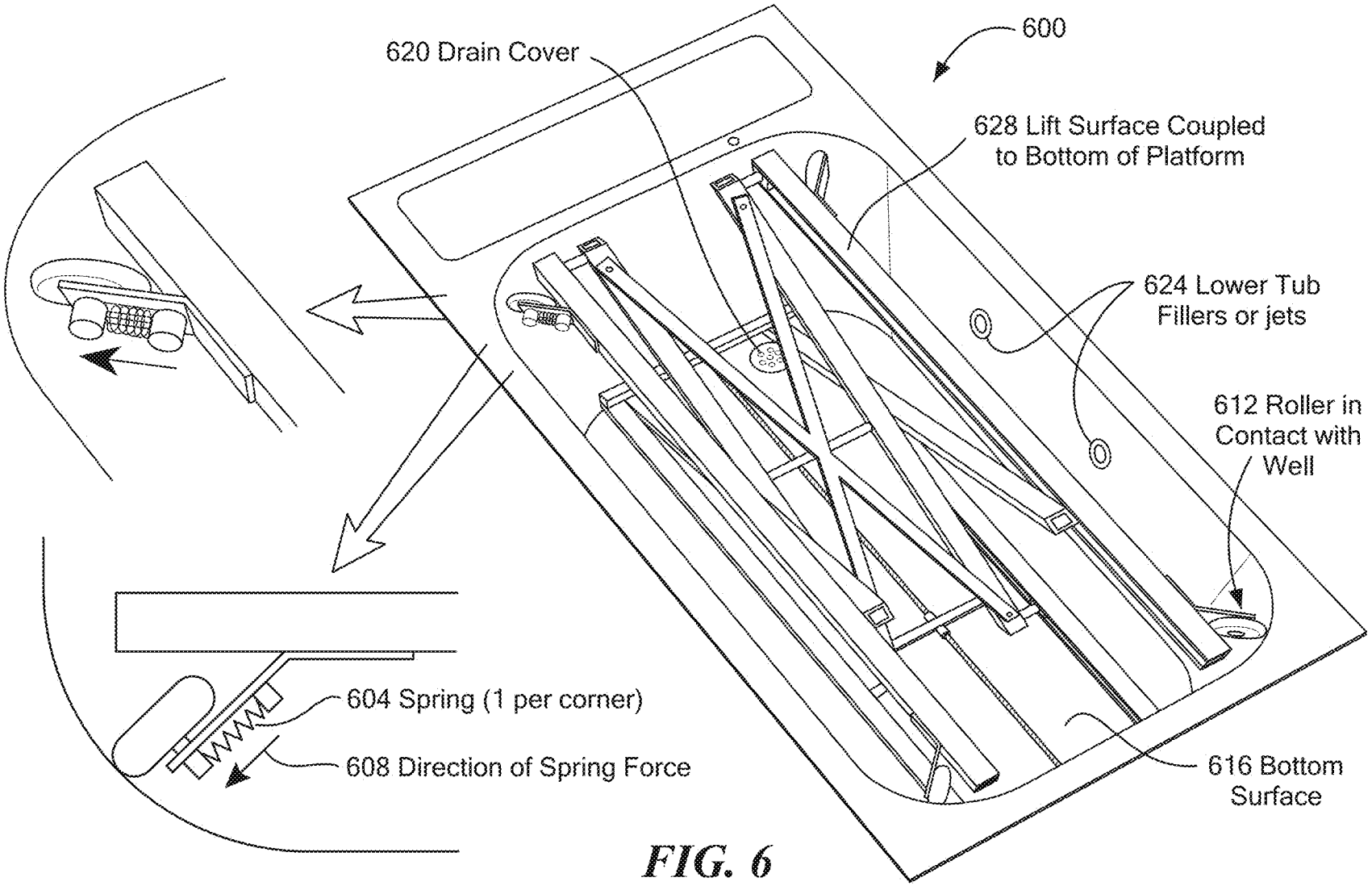
FIG. 6 schematically shows a perspective view of a lift within a tub in accordance with illustrative embodiments of the invention.

FIG. 6 schematically shows a perspective view of a lift 408 within the tub 104 in accordance with illustrative embodiments of the invention. FIG. 6 omits the platform 108 to more clearly illustrate the relationship between the lift 408 and the tub 104.

As explained previously, each corner of the lift 408 has associated vertically-oriented rollers 504. Associated with each roller 504 may be a spring 604 in compression, which in illustrative embodiments is configured to provide outward force 608 to the rollers 504 to main contact 612 with inside corners of the well 304. In other embodiments, other types of force members may be used to provide outward force to the rollers 504 to maintain contact with the well 304, such as springs in expansion, resilient polymer or rubber blocks, and the like. Springs or other resilient members may beneficially provide a cushioning force to reduce vibration to the platform 108 while the platform 108 is being raised or lowered.

FIG. 6 illustrates an inside bottom surface 616 of the tub 104 and a drain cover 620 as a cover plate to the macerator 328 and the drain 316. In one embodiment, the drain cover 620 may be removable to facilitate removal of hair and other debris from the drain cover 620. In one embodiment, removal of the drain cover 620 may inhibit operation of the macerator 328 to enhance safety during maintenance operations. For example, a microswitch in the bottom surface 308 of the tub 104 or a top surface of the macerator 328 may interrupt power applied to the macerator 328 when the microswitch is open (i.e., corresponding to the drain cover 620 removed). When the microswitch is closed (i.e., the drain cover 620 in-place), power may be routed to the macerator 328, allowing operation.

With the platform 108 removed for illustrative purposes, lift surfaces 628 in contact with the bottom of the platform 108 are shown. In the example of a scissors-type lift shown in FIG. 5, the lift surfaces 628 may be top surfaces of the upper parallel rails 508. In one embodiment, the well 304 may include any number of lower tub fillers or jets 624. For example, the accessible bath may include fillers 624 in addition to or instead of the upper tub filler 144 shown in FIGS. 1-3. They may fill the tub 104 to a desired water depth and temperature as required by the user 120. Where the lower tub jets 624 are present, the tub 104 may include a water return path (not shown) that is separate from the drain 316 and drain cover 620. The water return path may provide water already in the tub 104 to impellers or other actuators that produce water pressure to the jets 624, as well understood with respect to spa operation.

Figure 7A:
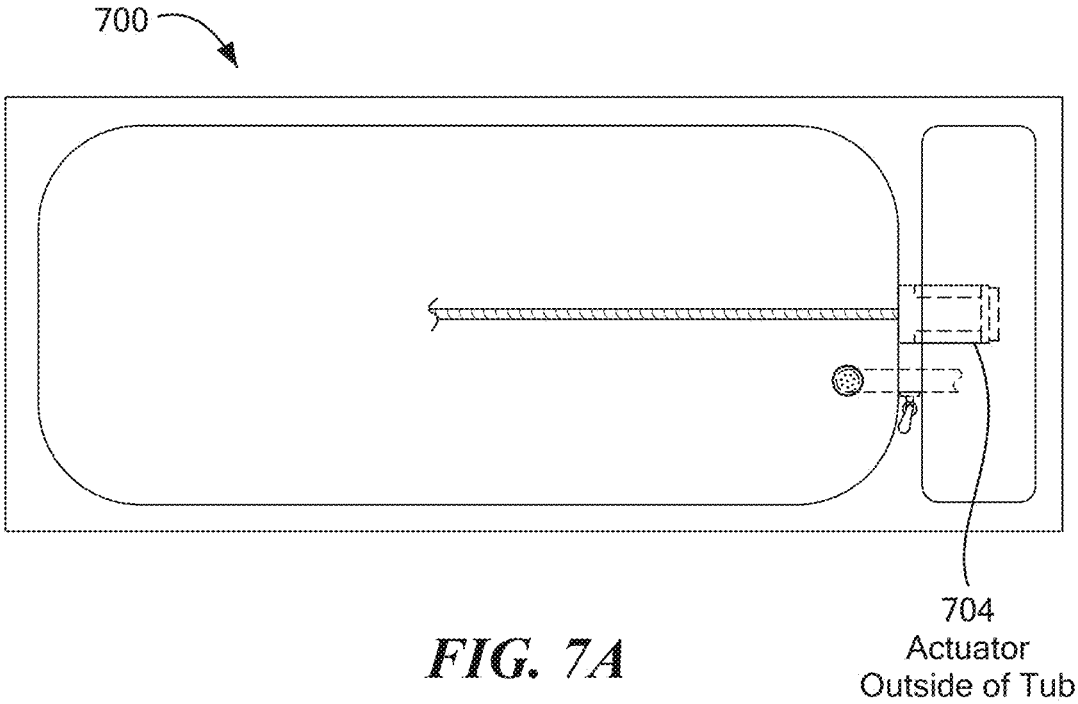
FIG. 7A schematically shows an overhead view of the accessible bath with an external actuator in accordance with illustrative embodiments of the invention.

FIG. 7A schematically shows an overhead view 700 of the accessible bath 100 with an external actuator 704 in accordance with illustrative embodiments of the invention. The actuator 704 may be mounted outside the tub 104, which may beneficially allow for a wider range of power sources to the actuator 704 while meeting safety regulations. However, maintenance access to the actuator 704 may not be performed through the access door 312 and may require use of the access panel 124 or another access method.

Figure 7B:
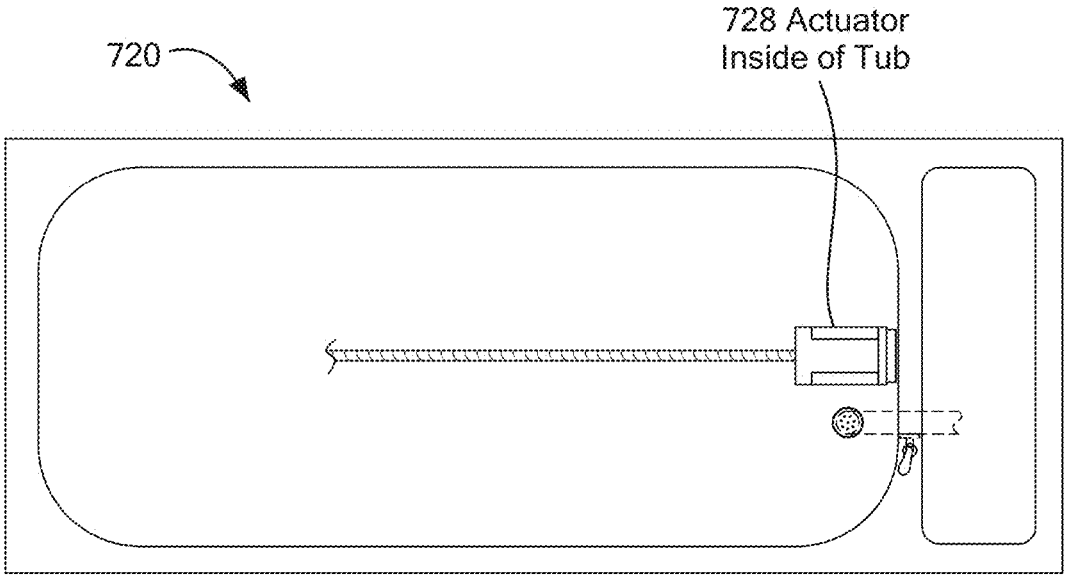
FIG. 7B schematically shows an overhead view of the accessible bath with an internal actuator in accordance with illustrative embodiments of the invention.

FIG. 7B schematically shows an overhead view 720 of the accessible bath 100 with an internal actuator 728 in accordance with illustrative embodiments of the invention. The actuator 728 may be mounted inside the tub 104, as shown herein. Because the actuator 728 will be submerged in water when the tub 104 is filled, a limited number of power sources to the actuator 728 may be required, such as low voltage DC power. However, maintenance access to the actuator 728 may be performed through the access door 312, and the drive shaft feedthrough 336 in the side of the tub 104 may not be required since the actuator 728 and the worm gear 412 are completely within the tub 104.

Figure 8:
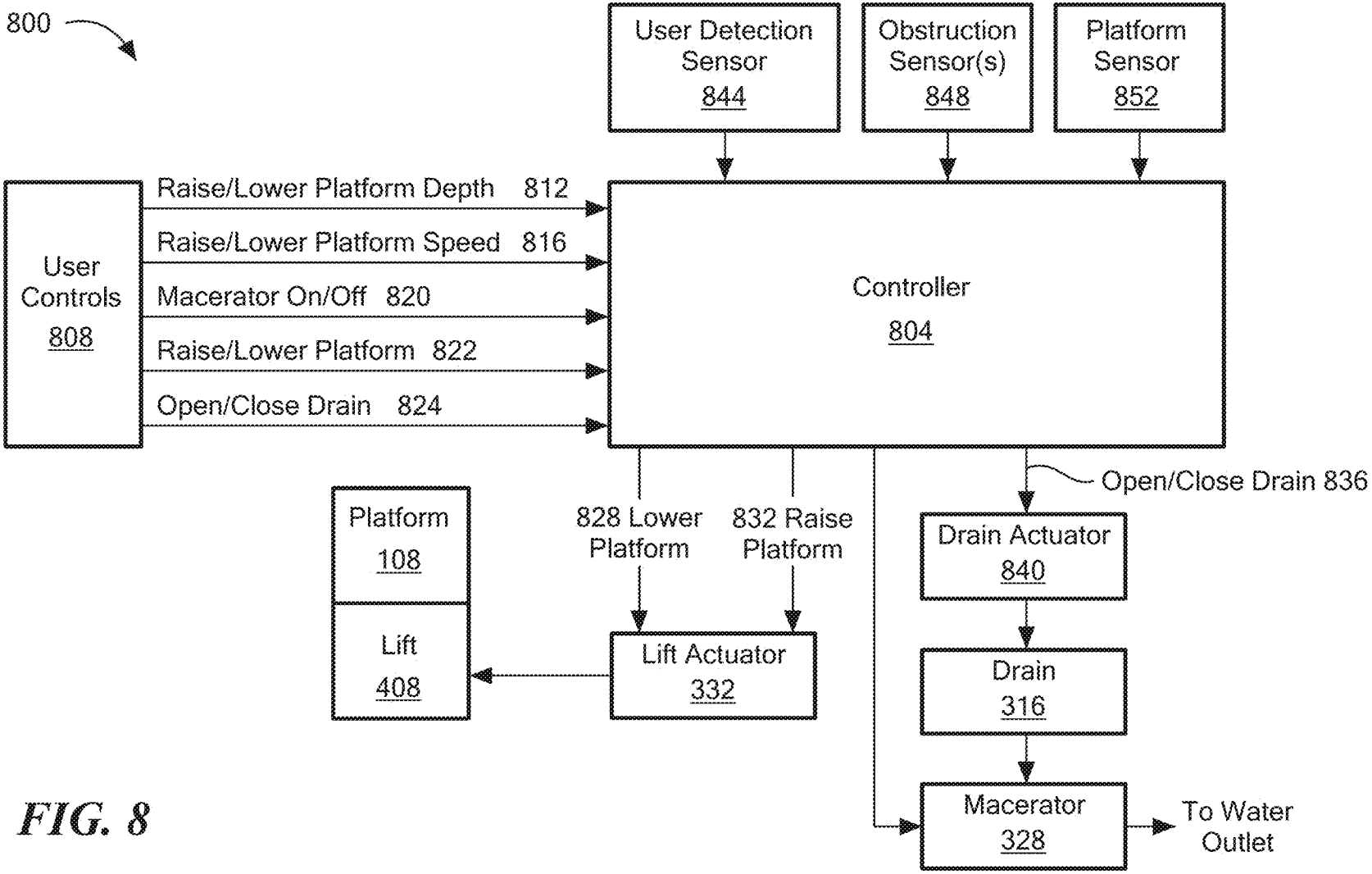
FIG. 8 shows a block diagram of control aspects of the accessible bath in accordance with illustrative embodiments of the invention.

FIG. 8 shows a block diagram 800 of control aspects of the accessible bath 100 in accordance with illustrative embodiments of the invention. FIG. 8 illustrates various features of the accessible bath 100 and is an example of a representative control block diagram. Specific embodiments may include fewer or more controlled features, and in some embodiments all or most control features may be manually actuated by the user 120 or other individual.

It should be noted that FIG. 8 only schematically shows each of these control aspects. Those skilled in the art should understand that each of these components can be implemented in a variety of conventional manners, such as by using hardware, software, or a combination of hardware and software, across one or more other functional components. For example, the controller 804 (discussed in detail below) may be implemented using a plurality of microprocessors executing firmware. As another example, the controller 804 may be implemented using one or more application specific integrated circuits (i.e., "ASICs") and related software, or a combination of ASICs, discrete electronic components (e.g., transistors), and microprocessors. Accordingly, the representation of the controller 804 and other components in a single box of FIG. 8 is for simplicity purposes only. In fact, in some embodiments, the controller 804 (or other components) of FIG. 8 may be distributed across a plurality of different machines—not necessarily within the same housing or chassis.

It should be reiterated that the representation of FIG. 8 is a simplified representation of an actual accessible bath 100. Those skilled in the art should understand that such a device has many other physical and functional components. Accordingly, this discussion is not intended to suggest that FIG. 8 represents all the elements of the tub 104.

As shown, in one embodiment, the accessible bath 100 includes the above noted controller 804. As known in the art, the controller 804 may include a processor, one or more memory devices, a user display device, a network connection, and/or may execute stored programs or applications. The controller 804 in such a form may be software-upgradeable to modify stored programs or applications and change system functionality. For example, a user 120 interacting with the system 800 may approve an available software update that allows user 120 profiles for multiple users to be programmed and stored in the memory devices rather than just for a single user. In another embodiment, the controller 804 may include manual switches, relays, indicators, or other components and not be programmable or software upgradable.

In one embodiment, the accessible bath may include user controls 808. Among other things, the controls 808 may provide selection inputs to the controller 804 to direct operation of the accessible bath, and in some embodiments provide feedback to the user 120 (e.g., indicator lights/legends, display, touchscreen, speaker, etc.) of the operating state of the accessible bath, error conditions, available options, and the like. User controls 808 may accept a touch selection on a touchscreen or control buttons, a verbal command, or detect a predetermined user 120 facial or hand gesture with a camera and associated image recognition software application (not shown). The user controls 808 may be mounted proximate to the user 120, such as on a wall adjacent to the accessible bath. In one embodiment, the user controls 808 may be implemented as a smartphone or other computing device (e.g., smartwatch, wearable computer, etc.) application. User controls 808 may include an open/close drain selection 824, a raise/lower platform selection 822, a macerator on/off selection 820, a raise/lower platform speed selection 816, and/or a raise/lower platform depth selection 812.

The open/close drain selection 824 may cause the controller 804 to generate a corresponding open/close drain control 836 to a drain actuator 840. The drain actuator 840 may be a solenoid or other form of actuator that opens or closes the drain 316 based on the state of the open/close drain control 836.

The raise/lower platform selection 822 causes the controller 804 to initiate raising or lowering the platform 108 from the platform's present location (i.e., raised or lowered). In response to a raise platform selection 822, the controller 804 generates a raise platform control 832 to the lift actuator 332, and the lift actuator 332 causes the lift 408 to raise the platform 108. In response to a lower platform selection 822, the controller 804 generates a lower platform control 828 to the lift actuator 332, and the lift actuator 332 causes the lift 408 to lower the platform 108.

The macerator on/off selection 820 controls the operation of the macerator 328. In one embodiment, when the macerator on/off selection reflects an "off" state, the controller 804 may disable the macerator 328 from operating, regardless of water flow through the drain 316. When the macerator on/off selection reflects an "on" state, the controller 804 may enable the macerator 328, which may run when water is flowing through the drain 316.

Ther raise/lower platform speed selection 816 designates a speed at which the platform 108 is raised or lowered. In one embodiment, multiple speeds may be selected by user controls 808 (e.g., 2 inches/second, 3 inches/second, 4 inches/second, or 5 inches/second). In another embodiment, the user 120 may specify a raising/lower speed on the user controls (e.g., 2.5 inches/second). The controller 804 may convert the received selection 816 into a discrete voltage or other means applied to the lower platform 828 and the raise platform 832 controls to the lift actuator 332.

The raise/lower platform depth selection 812 designates how deep within the well 304 the platform 108 descends. In one embodiment, the selections may represent discrete amounts or percentages (e.g., 25%, 50%, 75%, or 100%). In another embodiment, the user 120 may enter a discrete platform depth selection (e.g., 45%) on the user controls 808. In another embodiment, the user 120 may specify a desired platform depth 812 based on the seated user 120 (e.g., "ankle depth", "waist depth", "chest depth", "shoulder depth", etc.). In one embodiment, the controller 804 may convert the received raise/lower platform depth selection 812 into a time duration the lower platform 828 or raise platform 832 controls are activated. Some embodiments may save user preferred selections of the controls.

In one embodiment, the system 800 may include a user detection sensor 844. The user detection sensor 844 detects a seated user on the platform 108 to the controller 804. If the controller 804 does not receive an indication of a seated user 120 from the user detection sensor 844, the controller 804 may inhibit the lower platform 828 and the raise platform 832 controls until a seated user 120 is detected. Inclusion of a user detection sensor 844 may improve accessible bath safety by reducing the chance of a fall by the user 120 on a moving platform 108. The user detection sensor 844 may include one or more switches or optical sensors associated with the platform 108, a seat on the platform 108, or a wheelchair 156 (e.g., using a wireless transmitter to the controller 804). The user detection sensor 844 may also include one or more cameras that provide images to a user image detection software application that executes on the controller 804. The user image detection software may provide an indication to the controller 804 when the user 120 is seated or not seated on the platform 108. In one embodiment, the user detection sensor 844 may include a scale that measures a weight of the user 120 on the platform. The controller 804 may report the weight to the user through a display associated with user controls 808 and/or audibly through a speaker.

In one embodiment, the system 800 may include one or more obstruction sensors 848 that cause the controller 804 to inhibit the lower platform 828 and raise platform 832 controls to the lift actuator 332. For example, obstruction sensors 848 may detect when a foot of the user 120 is extending off the platform 108 when the platform 108 is being raised. This may prevent an injury if the foot is caught between the platform 108 and the top surface 116 of the tub 104. Other obstruction sensors 848 may be associated with various components of the lift 408 to prevent damage to the lift actuator 332 if the lift 408 is jammed or obstructed. In one embodiment, the controller 804 may reverse raising/lowering of the platform 108 either partially or fully if an indication from an obstruction sensor 848 is received.

The system 800 may include a platform sensor 852, which is configured to provide an indication to the controller 804 when a raising platform 108 becomes level with the top surface 116 of the tub 104. A flush and coplanar relationship between the platform 108 and the top surface 116 of the tub may improve safety by eliminating a lip that a user 120 may trip over. It also optimizes the ease of rolling a wheelchair 156 on or off the platform 108. In one embodiment, the platform sensor 852 may be associated with either the platform 108 or the tub 104 and may include a switch, an optical sensor, a camera, or any other type of sensor.

Figure 9A:
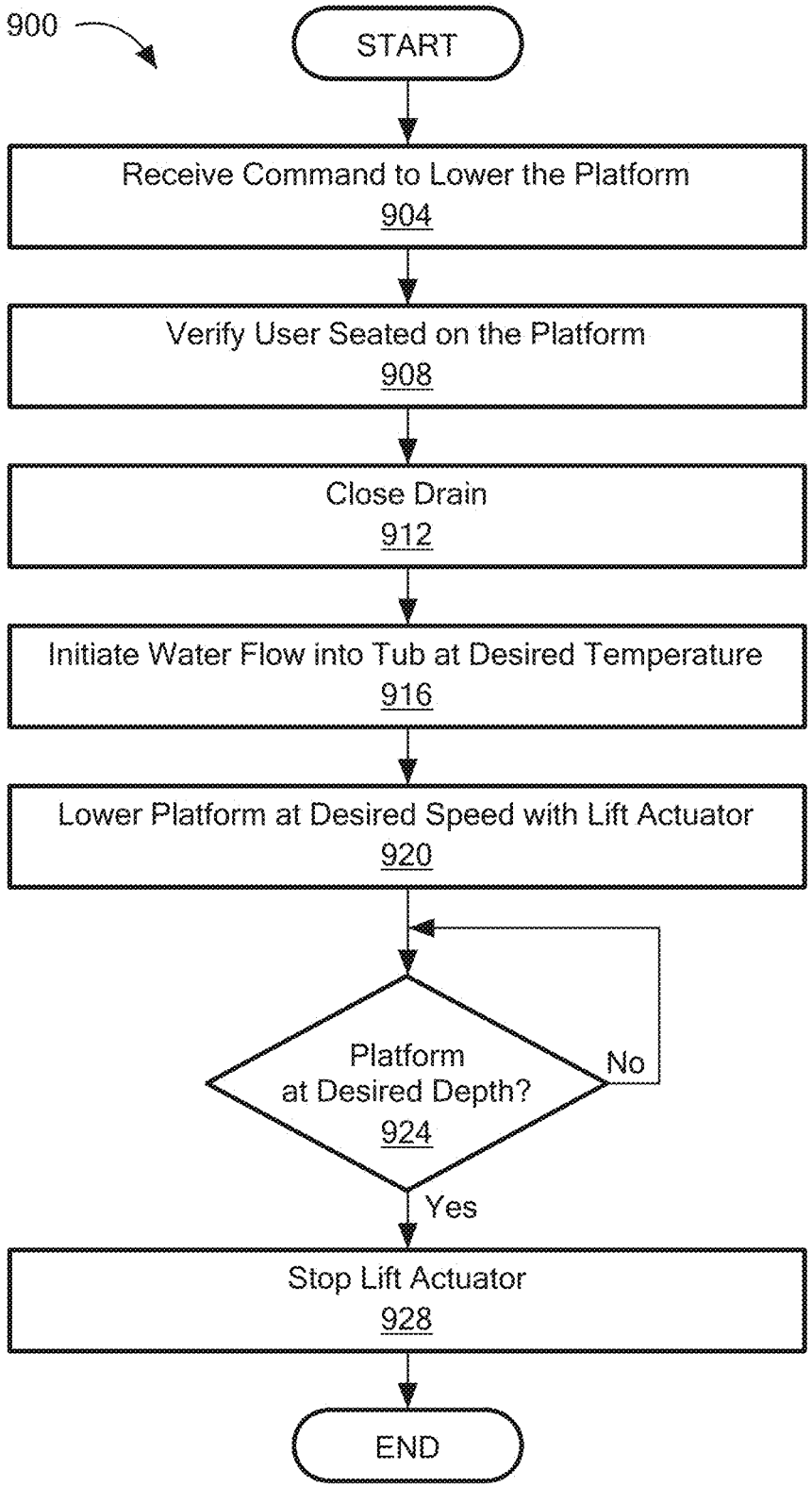
FIG. 9A shows a flowchart of a platform lowering process in accordance with illustrative embodiments of the invention.

FIG. 9A shows a flowchart of a platform lowering process 900 in accordance with illustrative embodiments of the invention. It should be noted that some of the steps may be performed in a different order than that shown, or at the same time. Those skilled in the art therefore can modify the process as appropriate.

The process begins at block 904, in which the controller 804 may receive a command to lower the platform 822. The command 822 may be received in conjunction with a raise/lower platform depth selection 812 and/or a raise/lower platform speed selection 816. Flow proceeds to block 908.

At block 908, the controller 804 may verify a user 120 is seated on the platform 108. In one embodiment, the controller 804 may receive an indication from a user detection sensor 844, as described herein. Flow proceeds to block 912.

At block 912, the controller 804, the user 120, or another individual may close the drain 316. In one embodiment, the controller 804 may visually or audibly present a request to the user 120 or other individual to close the drain 316, and the user 120 or other individual may manually close the drain 316 using the drain control 324. In another embodiment, the controller 804 may close the drain 316 using the open/close drain control 836 and drain actuator 840, as discussed herein. Flow proceeds to block 916.

At block 916, water flow is initiated into the tub 104 at a desired temperature. In one embodiment, the user 120 or other individual may manually operate one or more bath controls 140. In another embodiment, the controller 804 may control one or more water control actuators (not shown) to add water to the tub 104 under verbal or water selection controls from the user controls 808. Flow proceeds to block 920.

At block 920, the controller 804 lowers the platform 108 at a desired speed with the lift actuator 332. The user controls 808 may provide a raise/lower platform depth selection 812, a raise/lower platform speed selection 816, and a raise/lower platform selection 822 to the controller 804. In another embodiment, the user 120 or other individual may operate one or more manual controls to lower the platform at a desired speed and depth. Flow proceeds to decision block 924.

At decision block 924, the controller 804 may determine if the platform 108 has been lowered to a desired depth. In one embodiment, the raise/lower platform depth selection 812 may specify the depth that the platform 108 is to be lowered to. In another embodiment, the user 120 or other individual may use manual controls to stop the platform 108 at a desired depth. If the platform 108 has not reached the desired depth, then flow proceeds to decision block 924 to continue lowering until the desired depth has been reached. If the platform 108 has reached the desired depth, then flow proceeds to block 928.

At block 928, the controller 804, the user 120, or other individual may stop the lift actuator 332. In controller 804 embodiments, the controller 804 may inhibit or disable the lower platform control 828 to the lift actuator 332. In manual environments, the user 120 or other individual may use a manual control to inhibit or disable the lift actuator 332. Flow ends at block 928.

Figure 9B:
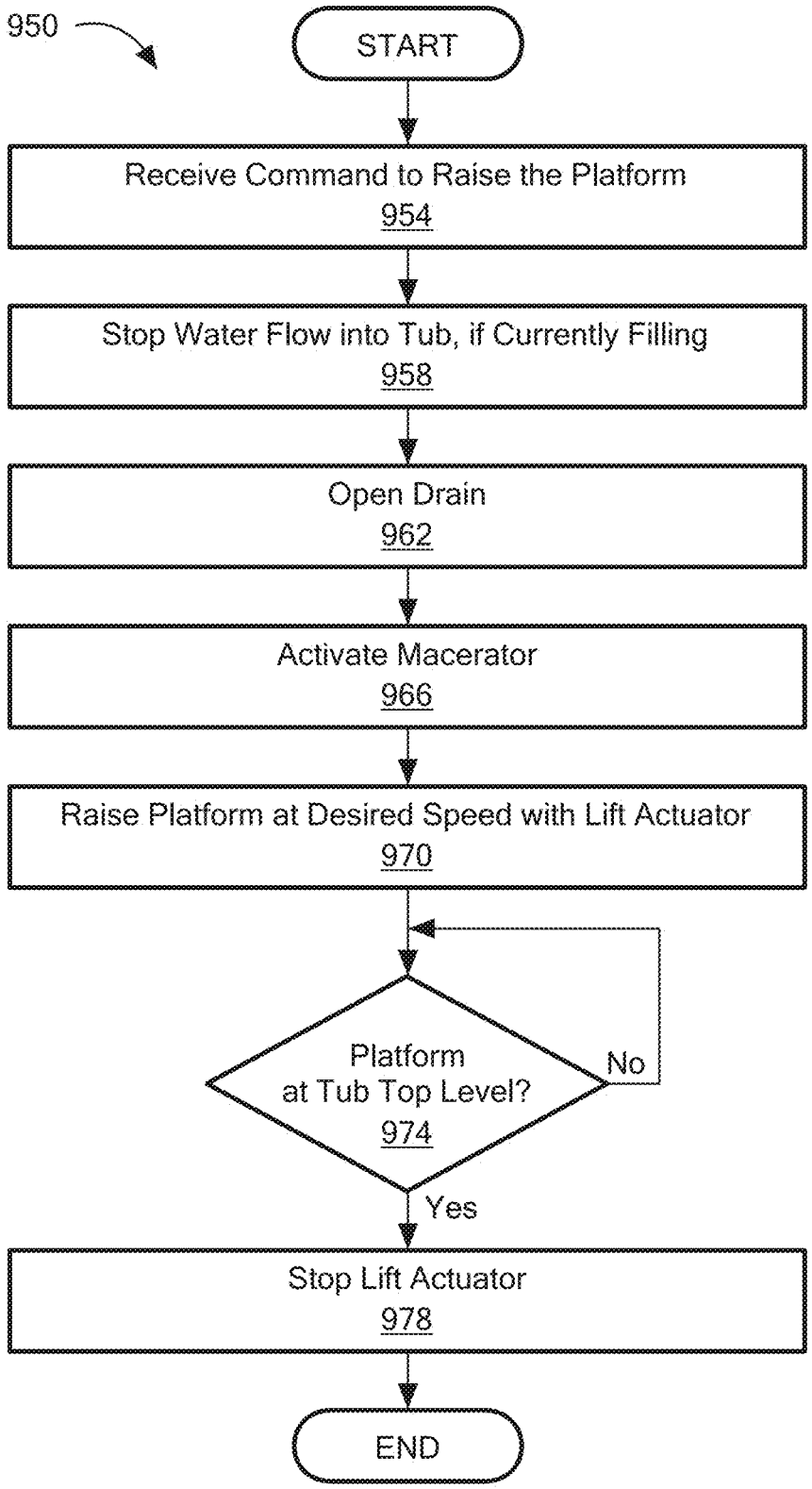
FIG. 9B shows a flowchart of a platform raising process in accordance with illustrative embodiments of the invention.

FIG. 9B shows a flowchart of a platform raising process 950 in accordance with illustrative embodiments of the invention. Flow begins at block 954.

At block 954, the controller 804 may receive a command to raise the platform 822. The command 822 may be received in conjunction with a raise/lower platform depth selection 812 and/or a raise/lower platform speed selection 816. Flow proceeds to block 958.

At block 958, the controller 804 may stop or inhibit water flow into the tub 104 if the tub 104 is currently being filled. In a manual embodiment, the controller 804 may visually or audibly request the user 120 or other individual to turn off the water using shower controls 136 and/or bath controls 140. In an automated embodiment, the controller 804 may control one or more water actuators (not shown) to stop water flow into the tub 104. Flow proceeds to block 962.

At block 962, the controller 804, the user 120, or another individual may open the drain 316. In one embodiment, the controller 804 may visually or audibly present a request to the user 120 or other individual to open the drain 316, and the user 120 or other individual may manually open the drain 316 using a drain control 324. In another embodiment, the controller 804 may open the drain 316 using the open/close drain control 836 and drain actuator 840, as discussed herein. Flow proceeds to block 966.

At block 966, the macerator 328 is activated. In a manual embodiment, the user 120 or other individual may operate a control from the user controls 808 that generates a macerator on/off selection 820 to the controller 804 and the controller activates the macerator 328. The macerator 328 is usable when water is flowing through the drain 316. In an automated embodiment, if the macerator on/off selection 820 reflects an "on" state, the controller 804 may automatically turn on the macerator 328 when water is flowing through the drain 316. Flow proceeds to block 970.

At block 970, the controller 804 raises the platform 108 at a desired speed with the lift actuator 332. The user controls 808 may provide a raise/lower platform depth selection 812, a raise/lower platform speed selection 816, and a raise/lower platform selection 822 to the controller 804. In another embodiment, the user 120 or other individual may operate one or more manual controls to raise the platform 108 at a desired speed and depth. Flow proceeds to decision block 974.

At decision block 974, the controller 804 may determine if the platform 108 has been raised to a top level of the tub 104. In one embodiment, controller 804 may stop the platform in response to the controller 804 receiving an indication from the platform sensor 852 that the platform 108 has reached the top surface 116 of the tub 104. In a manual embodiment, a user 120 or other individual may stop the platform 108 using a manual control. If the platform 108 has not reached the level of the top surface 116, then flow proceeds to decision block 974 to continue raising until the platform is level with the top surface 116. If the platform 108 has reached the level of the top surface 116, then flow proceeds to block 978.

At block 978, the controller 804, the user 120, or other individual may stop the lift actuator 332. In controller 804 embodiments, the controller 804 may inhibit or disable the raise platform control 828 to the lift actuator 332. In manual environments, the user 120 or other individual may use a manual control to inhibit or disable the lift actuator 332. Flow ends at block 978.

Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

What is claimed is:

1. A system comprising:

a tub that provides tub access to a seated user and includes a top surface, a bottom surface, and a concave well therebetween;

a platform that includes water openings extending therethrough; and a lift, coupled to a bottom surface of the platform, the lift disposed within the tub and configured to lower the platform within the well in response to detecting a user seated on the platform.

2. The system of claim 1, wherein the top surface of the tub is configured to be substantially coplanar with a floor of a building when installed.

3. The system of claim 1, wherein the system further comprises a controller coupled to one or more sensors, the one or more sensors configured to detect the user seated on the platform and cause the controller to raise or lower the platform.

4. The system of claim 1, further comprising:

a filler in one or more sides of the well, configured to add water at a predetermined temperature and volume to the tub.

5. The system of claim 1, further comprising:

a drain with connected overflow, proximate the bottom surface of the tub, configured to retain water within the well when closed and allow water to drain from the well when opened; and a macerator, coupled to the drain, configured to break up debris from the tub when water is drained and provide the water and broken up debris to a water outlet.

6. The system of claim 1, further comprising:

a door, within and coplanar with the platform, configured to provide access to the well and the lift when opened.

7. The system of claim 1, further comprising:

a plurality of vertical rollers, coupled to upper portions of the lift, configured to maintain a consistent distance between the lift and the well.

8. The system of claim 7, further comprising:

a plurality of springs, coupled to the plurality of rollers, to provide horizontal force to the plurality of rollers to maintain contact with side surfaces of the well.

9. A system, comprising:

a tub, configured to hold water and provide tub access to a seated user, the tub comprising:

top and bottom surfaces;

a concave well, affixed and conforming to an opening at the top surface; and a drain, disposed in proximity to the bottom surface, configured to retain water within the well when closed and allow water to drain from the well when opened;

a platform, configured to fit within the opening when in a raised position;

a lift, affixed to an underside of the platform, configured to raise the platform to the raised position and lower the platform within the well in response to a user seated on the platform; and an actuator, coupled to the lift, configured to cause the lift to raise or lower the platform.

10. The system of claim 9, wherein the system further comprises a controller coupled to one or more sensors, the one or more sensors configured to detect the user seated on the platform and cause the controller to raise or lower the platform.

11. The system of claim 10, wherein the controller is configured to disable movement of the platform when one or more sensors do not detect the user seated on the platform.

12. The system of claim 9, further comprising:

a filler in one or more vertical sides of the well, configured to add water at a predetermined temperature and volume to the tub.

13. The system of claim 9, further comprising:

a vertical member, coupled to the drain and extending at least to the top surface of the tub, configured to allow a user to open or close the drain.

14. A method, comprising:

closing a drain within a well of a tub to prevent water flow from the tub, the tub providing tub access to a seated user;

initiating a water flow at a desired temperature and volume into the tub;

controlling, by a lift coupled within the tub, a platform configured to allow water flow therethrough, the lift configured to raise or lower the platform within the well; and lowering, by the lift, the platform to a depth within the well in response to detecting the user seated on the platform.

15. The method of claim 14, wherein controlling the lift comprises:

rotating, by an actuator, a worm gear engaging threads of a threaded member of the lift, wherein a bottom surface of the platform is coupled to a top surface of the lift;

extending the threaded member away from the actuator, by the rotating; and lowering the platform, by the extending.

16. The method of claim 14, further comprising:

opening the drain; and activating a macerator, coupled to an output of the drain, to break up debris in water received from the drain.

17. The method of claim 14, further comprising:

disabling raising or lowering the platform in response to the user is not seated on the platform.

18. The method of claim 14, wherein initiating the water flow at the desired temperature and volume into the tub comprises:

selecting between an external water source outside the tub and an internal water source within the well;

selecting a desired water temperature from the selected water source; and selecting one or more of a desired water volume and a desired water depth within the well.

19. The method of claim 14, further comprising:

receiving a command at a controller, and in response:

determining the user is seated on the platform, and in response:

closing the drain;

initiating the water flow;

controlling the platform; and lowering the platform to a depth within the well.

20. The method of claim 14, further comprising:

receiving a command at a controller, and in response disabling the water flow into the tub and opening the drain; and raising, by the lift, the platform to a level coplanar with the top surface of the tub.

* * * * *